US008631598B2

(12) United States Patent
Li et al.

(10) Patent No.: US 8,631,598 B2
(45) **Date of Patent: *Jan. 21, 2014**

(54) LIGHT EMITTING SIGN AND DISPLAY SURFACE THEREFOR

(75) Inventors: Yi-Qun Li, Danville, CA (US); Yi Dong, Tracy, CA (US); James Caruso, Albuquerque, NM (US); Charles Edwards, Pleasanton, CA (US)

(73) Assignee: Intematix Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/102,898

(22) Filed: May 6, 2011

(65) Prior Publication Data

US 2011/0209367 A1 Sep. 1, 2011

Related U.S. Application Data

(63) Continuation of application No. 11/714,711, filed on Mar. 6, 2007, now Pat. No. 7,937,865.

(60) Provisional application No. 60/780,902, filed on Mar. 8, 2006.

(51) Int. Cl.
*G09F 13/20* (2006.01)

(52) U.S. Cl.
USPC ..... 40/542; 40/546; 362/84; 362/293

(58) Field of Classification Search
USPC ..... 40/564, 542, 546, 550; 362/84, 293, 362/559
See application file for complete search history.

(56) References Cited

U.S. PATENT DOCUMENTS

| | | | |
|---|---|---|---|
| 2,509,707 | A | 5/1950 | Taylor |
| 3,504,214 | A | 3/1970 | Cox et al. |
| 3,510,976 | A | 5/1970 | Parry et al. |
| 3,780,462 | A | 12/1973 | Pregel et al. |
| 4,971,417 | A | 11/1990 | Krinsky et al. |
| 5,856,031 | A | 1/1999 | Burrows |
| 6,068,383 | A | 5/2000 | Robertson et al. |

(Continued)

FOREIGN PATENT DOCUMENTS

| | | | |
|---|---|---|---|
| CN | 1655657 | A | 8/2005 |
| GB | 2404775 | A | 2/2005 |

(Continued)

OTHER PUBLICATIONS

Non-Final Office Action dated May 4, 2010 for U.S. Appl. No. 11/714,711.

(Continued)

*Primary Examiner* — Gary Hoge
(74) *Attorney, Agent, or Firm* — Vista IP Law Group, LLP

(57) ABSTRACT

A light emitting sign comprising a plurality of blue LEDs operable to generate blue excitation light and a light emitting display surface comprising a light transmissive substrate and at least one phosphor overlaying at least a portion of one face of the substrate. The phosphor is configured to absorb at least a portion of the blue light generated by the LEDs and, in response, to emit light of a selected color other than blue. Regions of the display surface intended to generate blue light do not include the phosphor.

13 Claims, 11 Drawing Sheets

(56) References Cited

U.S. PATENT DOCUMENTS

| | | | |
|---|---|---|---|
| 6,250,767 | B1 | 6/2001 | Kusafuka et al. |
| 6,299,338 | B1 | 10/2001 | Levinson et al. |
| 6,883,926 | B2 | 4/2005 | Wojnarowski |
| 7,052,152 | B2 | 5/2006 | Harbers et al. |
| 7,091,661 | B2 | 8/2006 | Ouderkirk et al. |
| 7,246,919 | B2 | 7/2007 | Porchia et al. |
| 2002/0186556 | A1 | 12/2002 | Wojnarowski |
| 2003/0182833 | A1 | 10/2003 | Lewis |
| 2003/0218180 | A1 | 11/2003 | Fujiwara |
| 2003/0227007 | A1 | 12/2003 | Ezuhara et al. |
| 2004/0173807 | A1 | 9/2004 | Tian et al. |
| 2006/0001037 | A1 | 1/2006 | Schardt et al. |

FOREIGN PATENT DOCUMENTS

| | | | | |
|---|---|---|---|---|
| JP | 9-258678 | | | 10/1997 |
| JP | 2009265634 | A | * | 11/2009 |
| TW | M278984 | | | 10/2005 |
| WO | WO 00/01986 | A1 | | 1/2000 |
| WO | WO 2006017595 | A2 | | 2/2006 |

OTHER PUBLICATIONS

Notice of Allowance dated Jan. 28, 2011 for U.S. Appl. No. 11/714,711.

Non-Final Office Action dated May 1, 2012 for U.S. Appl. No. 13/087,549.

Non-Final Office Action dated Oct. 11, 2011 for U.S. Appl. No. 13/102,833.

Notice of Allowance dated May 8, 2012 for U.S. Appl. No. 13/102,833.

Office Action dated Mar. 16, 2011 for Chinese Appln. No. 200780012858.8.

Office Action dated Mar. 8, 2010 for Chinese Appln. No. 200780012858.8.

Office Action dated Oct. 2, 2012 for Japanese Appln. No. 2008-558362.

Office Action dated Feb. 6, 2010 for Taiwanese Appln. No. 096107849.

Office Action dated Oct. 6, 2010 for Taiwanese Appln. No. 096107849.

Final Office Action dated Aug. 7, 2012 for U.S. Appl. No. 13/087,549.

Search Report & Written Opinion dated Oct. 19, 2007 for PCT Appln. No. PCT/US07/05729.

European Extended Search Report dated Jul. 29, 2013 for EP Appln. No. 07752430.4.

Non-Final Office Action dated Jul. 11, 2013 for U.S. Appl. No. 13/273,208.

* cited by examiner

LIGHT EMITTING SIGN AND DISPLAY SURFACE THEREFOR

CROSS REFERENCE TO PRIOR APPLICATIONS

This application is a continuation of U.S. patent application Ser. No. 11/714,711, filed Mar. 6, 2007, entitled "Light Emitting Sign and Display Surface Therefor," which claims the benefit of priority to U.S. Provisional Application No. 60/780,902, filed Mar. 8, 2006, which applications are incorporated herein by reference in their entirety.

BACKGROUND OF THE INVENTION

1. Field of the Invention

The invention relates to light emitting signs and light emitting display surfaces for generating fixed images, graphics, photographic images and characters of a desired color of light. In particular the invention concerns light emitting signs which utilize a semiconductor light emitting diode (LED) and a phosphor (photo luminescent) material to generate a desired color of emitted light. Moreover the invention relates to generating colored light over large surface areas.

2. Description of the Related Art

Light emitting signs/displays, sometimes termed illuminated signs or displays, are used in many applications including: name signs for business premises using fixed graphics and characters, fixed image signs for advertising, emergency signs such as exit signs, traffic signals, road signs for example speed limit, stop, give way (yield) signs, direction indicator signs to name but a few.

A common way to make light emitting signs is in the form of a backlit sign or display which uses a "light box" containing one or more white light source such as for example fluorescent tubes, neon lights or incandescent bulbs. A front panel of the display comprises a transparent color filter, often a colored transparent acrylic sheet, which selectively filters the white light to provide the desired color light emission, graphic or image. Often, the light box is custom fabricated from sheet metal as a rectangular box or as a box in the shape of a required letter/character/symbol (channel letter) and such construction in conjunction with the white light source can account for a significant proportion of the total cost of the sign. The color pigments, dyes or colorants, used in these systems are transparent color filters which absorb the unwanted color light. This method is used for most light emitting signs and fixed displays as well as light emitting transparencies and many colored lights. A disadvantage of such signs is that a color filter has to be fabricated for every color required which increases the cost. In practice to minimize cost, the number of colors is limited to twenty or so. In addition, while such signs give a good performance at night they give poor color performance in daylight conditions due to their mode of operation which relies on the transmission rather than reflection of light and such signs can appear "washed out". Moreover, increasing the brightness of the signs leads to a bleeding through of the white backlight which leads to a shift in color saturation, e.g. deep red is washed out and appears whitish (pink) red. This effect is due to the "pigment strength" of the colored transparent faceplate which is optimized for an emissive mode (nighttime) of operation and consequently the performance in a reflective mode (daytime) of operation is often far from acceptable.

There is another approach used today for single color signs and displays. A single colored light source may be used that matches the target color (e.g. red LEDs in stop lights and car tail lights). For large area color signs, architectural lighting and accent lighting it is common to have large sections of single colors using this method of dedicated color lights.

It is further known to construct signs, for example traffic signs, using an array of LEDs in which the LEDs are arranged in the form of the sign such as for example arrow symbols and "walk/stop" devices used in pedestrian crossings where the designed "native" emitted wavelength of light from the LED is the same as the viewed or perceived colored light of the viewer. Often such signs will further include a color filter or lens to give a more uniform color/intensity of emitted light or to shift the color (as in the case of the use of a white LED with an orange filter to generate an orange colored sign and/or display or lighting element).

White light emitting diodes (LEDs) are known in the art and are a relatively recent innovation. It was not until LEDs emitting in the blue/ultraviolet of the electromagnetic spectrum were developed that it became practical to develop white light sources based on LEDs. As is known white light generating LEDs ("white LEDs") include a phosphor, that is a photo luminescent material, which absorbs a portion of the radiation emitted by the LED and re-emits radiation of a different color (wavelength). For example the LED emits blue light in the visible part of the spectrum and the phosphor re-emits yellow or a combination of green and red light, green and yellow or yellow and red light. The portion of the visible blue light emitted by the LED which is not absorbed by the phosphor mixes with the yellow light emitted to provide light which appears to the eye as being white.

It is predicted that white LEDs could potentially replace incandescent, fluorescent and neon light sources due to their long operating lifetimes, potentially many 100,000 of hours, and their high efficiency in terms of low power consumption. Recently high brightness white LEDs have been used to replace the conventional white fluorescent and neon lights in display backlight units. The colored materials with these white backlights come in a variety of forms such as vinyl films, colored polycarbonates and acrylics, color photographic transparency film, transparent colored inks for screen printing etc. All of these materials work on the same basic principle that they contain transparent colored dyes or pigments which absorb the unwanted colors of the backlight white and transmit the desired color to the viewer. Consequently they all function as color filters. Whilst the use of white LEDs has decreased the power consumption of backlit light emitting signs they still give a poor performance in terms of color saturation when operated in daylight conditions, often the color appears washed out.

U.S. Pat. No. 6,883,926 discloses an apparatus for display illumination which comprises a display surface which includes a phosphor material and at least one light emitting semiconductor device (LED) positioned to excite the phosphor by irradiating it with electromagnetic radiation of an appropriate wavelength. U.S. Pat. No. 6,883,926 teaches backlit and front lit variations. Such an apparatus finds particular application in vehicle instrumentation displays.

The present invention arose in an endeavor to provide an improved light emitting sign which provides greater flexibility and which in part at least overcomes the limitations of the known signs. Moreover it is an objective of the invention to provide a light emitting sign which offers increased brightness in emitted light with a reduced deterioration in color saturation and quality.

SUMMARY OF THE INVENTION

According to the present embodiments, a light emitting sign comprises: a light emitting display surface including at least one phosphor; and at least one radiation source operable to generate and radiate excitation energy of a selected wavelength range, the source being configured to irradiate the display surface with excitation energy such that the phosphor emits radiation of a selected color and wherein the display surface is selectable to give a different selected color of emitted light from the same radiation source. Since a single low cost color excitation source can be used for generating any color, this eliminates need for diverse color sources and reduces cost. Moreover, the sign has better light uniformity compared to conventional backlight systems which are prone to hot spots and shadows. In addition the sign has increased color saturation and improved power efficiency as the phosphor is used to generate the selected color of light rather than a filter which absorbs unwanted colors from a white light source.

The at least one phosphor can be provided on at least a part of an inner or outer surface of the display surface or incorporated within at least a part of the display surface.

To give a multi colored sign, or a sign of a selected color/hue, the sign further comprises first and second phosphors which are provided on at least a part of an inner or outer surface of the display surface. Alternatively, or in addition, the first phosphor is provided on at least a part of an inner surface of the display surface and the second phosphor provided on at least a part of an outer surface of the display surface. The first and second phosphors can be provided as respective layers; as a mixture in at least one layer; or provided adjacent each other. In a further arrangement the phosphors are incorporated within at least a part of the display surface.

The sign further comprises a filter which is substantially transparent to light emitted by the display surface and filters other colors of light. The filter (preferably a colored transparent acrylic, vinyl or a like) is disposed in front of the display surface such that light reflected by the filter appears to be substantially the same color as light emitted by the display surface. Use of a color reflective filter, termed reflective color enhancement, gives a superior color performance in daylight conditions and reduces "washing out" of the sign. (colored transparent acrylic, vinyl or the like).

To improve uniformity of intensity the display surface further comprises light diffusing means.

In one arrangement the display surface is configured in a shape of a character, a symbol or a device. Alternatively, or in addition, the sign further comprises a mask having at least one window substantially transparent to the emitted light and/or at least one light blocking region, the window and/or light region defining a character, a symbol or a device.

In one arrangement the display surface comprises a wave guiding medium and the excitation source is configured to couple the excitation energy into the display surface. In such an arrangement the display surface can be a substantially planar surface and the excitation energy is coupled into at least a part of an edge of the display surface. Such an arrangement eliminates a need for a light box and provides a compact sign whose thickness is substantially the same as the thickness of the display surface. Preferably where the display surface is planar the sign further comprises a reflector on at least a part of the surface opposite to the light emitting surface to enhance the light output from the light emitting surface. In an alternative arrangement in which the display surface is a wave guiding medium the display surface is elongate in form and the excitation energy is coupled into at least a part of an end of the display surface. In one arrangement the display surface is tubular and includes a bore. To increase the light output, a reflector is provided on at least a part of the surface of the bore. In a further arrangement the display surface is solid in form and further comprises a reflector on a part of an outer surface of the display surface to increase light output in a preferred direction.

When the display surface is backlit or front lit the display surface can comprise a substantially planar surface; be elongate in form having a bore in which the at least one excitation source is provided or solid elongate in form and in which the at least one excitation source is incorporated. The display surface can be fabricated from a plastics material, polycarbonate, a thermoplastics material, a glass, acrylic, polythene, or a silicone material.

Advantageously the excitation source is a light emitting diode (LED). Use of an LED is cleaner environmentally as it eliminates the need for a mercury based lamp. Preferably the LED is operable to emit radiation of wavelength in a range 350 (U.V.) to 500 nm (Blue). An LED provides an increased operating life expectancy, typically 100,000 hours, fifteen times a conventional light source, leading to reduced maintenance. In a preferred implementation the LED is operable to emit radiation of wavelength in a range 410 to 470 nm, blue light. A particular advantage of using a blue light excitation source is that a full palette of selected colors can be generated using a combination of only red and yellow emissive phosphors.

The present invention can contemplate any sign type and may include the following a name sign, advertising sign, emergency indicator sign, traffic signal, road sign or direction indicator sign.

According to second aspect of the invention there is provided a light emitting display surface for a light emitting sign in accordance with the first aspect of the invention in which the display surface is selectable to give a different selected color of emitted light from the same radiation source.

The use of a reflective color filter to provide reflective color enhancement is considered inventive in its own right and thus according to a third aspect of the invention a light emitting sign comprises: a light emitting display surface including at least one phosphor; at least one radiation source operable to generate and radiate excitation energy of a selected wavelength range, the source being configured to irradiate the display surface with excitation energy such that the phosphor emits radiation of a selected color; and a filter which is substantially transparent to light emitted by the display surface and filters other colors of light. Preferably, the filter is disposed in front of the display surface such that light reflected by the filter appears to be substantially the same color as light emitted by the display surface.

According to a fourth aspect of the invention a light source comprises: a light emitting surface including at least one phosphor; and at least one radiation source operable to generate and radiate excitation energy of a selected wavelength range, the source being configured to irradiate the light emitting surface with excitation energy such that the phosphor emits radiation of a selected color and wherein the light emitting surface is selectable to give a different selected color of emitted light from the same radiation source. An advantage of a light source in accordance with the invention is that it reduces the quantity of phosphor required.

The at least one phosphor can be provided on at least a part of an inner or outer surface of the light emitting surface or be incorporated within at least a part of the light emitting surface.

According to a further aspect a light emitting sign comprises: a light emitting display surface and a light source according to the fourth aspect of the invention. Preferably, the display surface further includes reflective color enhancement and comprises a filter which is substantially transparent to light emitted by the surface and filters other colors of light such that light reflected by the filter appears to be substantially the same color as light emitted by the display surface.

BRIEF DESCRIPTION OF THE DRAWINGS

In order that the present invention is better understood embodiments of the invention will now be described, by way of example only, with reference to the accompanying drawings in which.

DETAILED DESCRIPTION OF THE INVENTION

Figure 1:
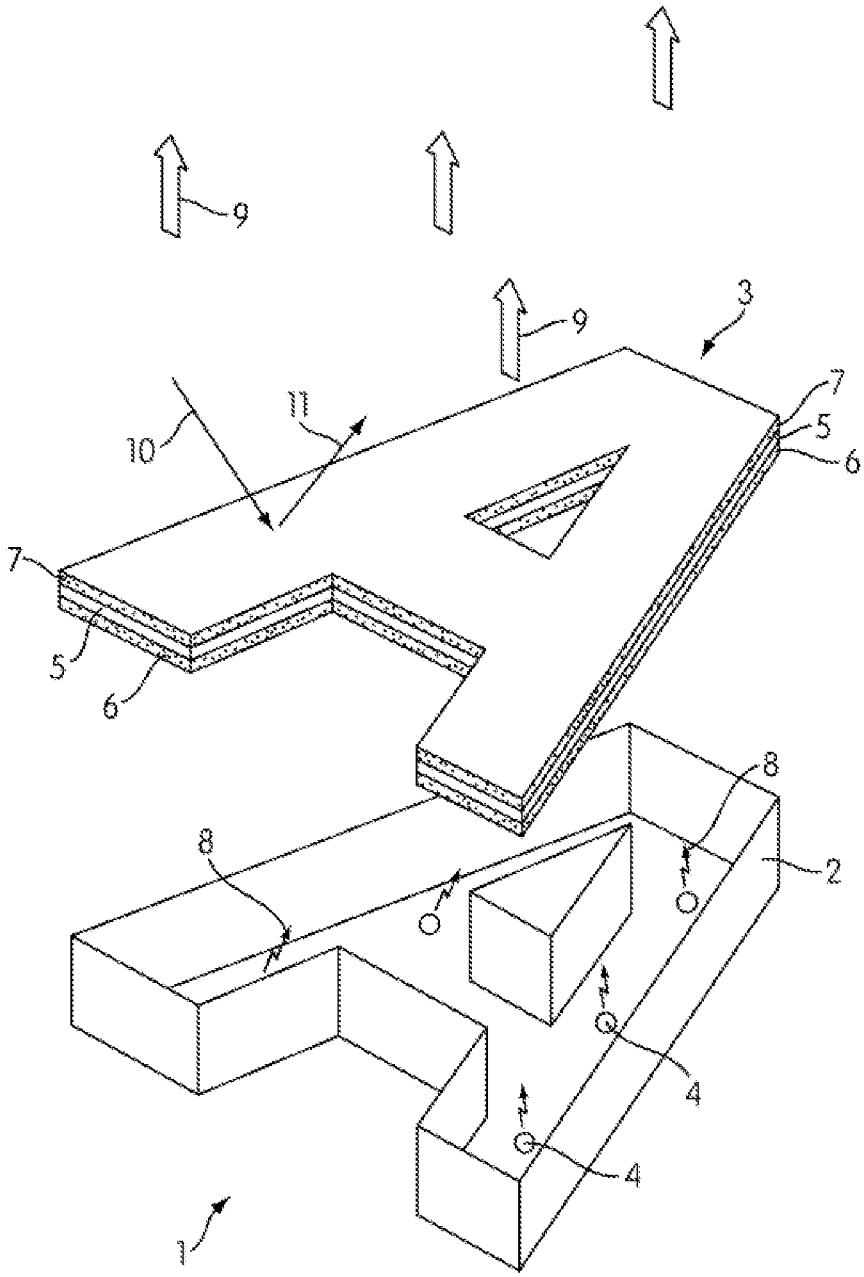
FIG. 1 is an exploded perspective view of a backlit light emitting sign in accordance with the invention.

Referring to FIG. 1 there is shown an exploded perspective view of a backlit light emitting sign 1 in accordance with the invention. In the example illustrated the sign 1 is intended to generate a letter "A" and comprises a light box 2 which is configured in the shape of the letter "A". The light box can be fabricated from sheet metal, molded from a plastics material or constructed from any other suitable material. The inner surface of the light box preferably includes a light reflective surface to reflect light towards a light emitting display surface 3 of the sign. A number of light emitting diodes (LEDs) 4 are provided within the light box 2 and are preferably blue LEDs which emit blue light in a wavelength range 410 to 470 nm.

The light emitting display surface 3 is substantially planar in form and is configured in shape to define the letter "A". The display surface 3 comprises a transparent/translucent substrate 5 such as for example a polycarbonate, polythene, acrylic or glass sheet. A layer of phosphor material 6, photo luminescent material, is provided on an under surface, that is the surface facing the LEDs, of the substrate 5. Any appropriate phosphor 6 can be used such as for example ortho silicate, silicate and aluminate materials provided they are excitable by the radiation emitted by the LEDs 4. Since in preferred embodiments the phosphors are emissive and activated in response to blue light, the phosphors will herein be termed Blue Activated Emissive Color (BAEC) phosphors.

On an outer surface of the substrate 5 a color enhancement filter layer 7 is provided to enhance the color performance of the sign in daylight conditions.

In operation light 8 emitted by the LEDs irradiates the phosphor layer 6 causing excitation of the phosphor which emits light of a different color which passes through the substrate 5 and filter 7 to produce light emission 9 from the display surface of a selected color. The color enhancement filter 7 is selected to be substantially transparent to the color of light 9 emitted from the display and filters other colors of light. When the display surface is subject to daylight 10 the color enhancement filter 7 will reflect only light 11 whose color substantially corresponds to the selected color of light 9 emitted by the sign thereby giving an enhanced color performance. This is termed Reflective Color Enhancement and is considered inventive in its own right. The color enhancement filter 7 can comprise a color pigment and/or colored dye which is incorporated in for example a vinyl film or mixed with a binder material and provided as a layer on the substrate 5. As is known color pigments are in soluble and can be organic such as for example Ciba's RED254, a DIKETO-PYRROLO-PYRROLE compound or inorganic such as for example iron oxide, while color dyes are soluble.

Being based on color emissive phosphors, in particular Blue Activated Emissive Colorants (BAECs), the sign of the prevent invention gives substantially improved color saturation and efficiency compared the known sign based on color transmissive (color absorbent) filters, see TABLE 1.

TABLE 1

Input powers versus output light color to produce the same light output intensity for a BAEC phosphor sign in accordance with the invention and a known sign utilizing a color filter and fluorescent lamp.

| | Input Power (W) | | |
|---|---|---|---|
| Color | BAEC Phosphor | Color filter with fluorescent lamp | % Powering Saving |
| Red | 3.71 | 8.00 | 53.6% |
| Green | 1.79 | 8.00 | 77.6% |
| Yellow | 4.31 | 8.00 | 46.2% |

The use of blue light in conjunction with a combination of red and green light emissive phosphors enables a virtually continuous palette of light colors/hues to be generated by the display surface from a single color excitation source, preferably an inexpensive blue LED. For example blue light can be generated by an LED alone without the need for a phosphor. Red light can be generated by use of a thick layer of red phosphor and green light by a thick layer of green phosphor. In the context of this patent application a thick layer means that there is sufficient quantity/concentration of phosphor to absorb all of the incident excitation radiation. Yellow light can be produced by a green phosphor whose quantity is insufficient to absorb all of the blue light impinging on it such that the emitted light 9 is a combination of blue and green light which appears yellow in color to the eye. In a like manner mauve/purple light can be produced using a red phosphor whose quantity is insufficient to absorb all of the blue light such that the blue light combined with yellow light emitted give an emitted light 9 which appears mauve in color to the eye. White light can be produced by a combination of red and yellow phosphors. It will be appreciated that a virtually continuous palette of colors and hues can be generated by an appropriate selection of phosphor material combination and/or quantity. The inventors contemplate providing the display surface in a full range of colors which can then be cut into a desired symbol, character or device to suit a customer's application. Moreover, the use of BAEC to generate a full gamut of colors is considered inventive in its own right.

In another arrangement a U.V. emitting LED can be used as the phosphor excitation source though such a source requires use of a blue emissive phosphor. A disadvantage of a U.V. excitation sources is that it can lead to a degradation the display surface when it is made of a plastics material and special care needs to be taken to prevent U.V. light escaping which can be harmful to an observer. A further advantage of the use of blue light excitation is that it is relatively safe to an observer compared to U.V. and consequently, the sign can be lit in many different ways such as for example front lit with a blue flood-lighting.

As illustrated in FIG. 1 the phosphor and/or phosphors can be provided on the underside of the substrate 5 as one or more respective layers with a binder material. Alternatively, the phosphors can be provided as a mixture in a single layer. Moreover, the phosphor layer can be provided on the outer surface of the substrate 5 or incorporated within the substrate material during manufacture.

Figure 2A:
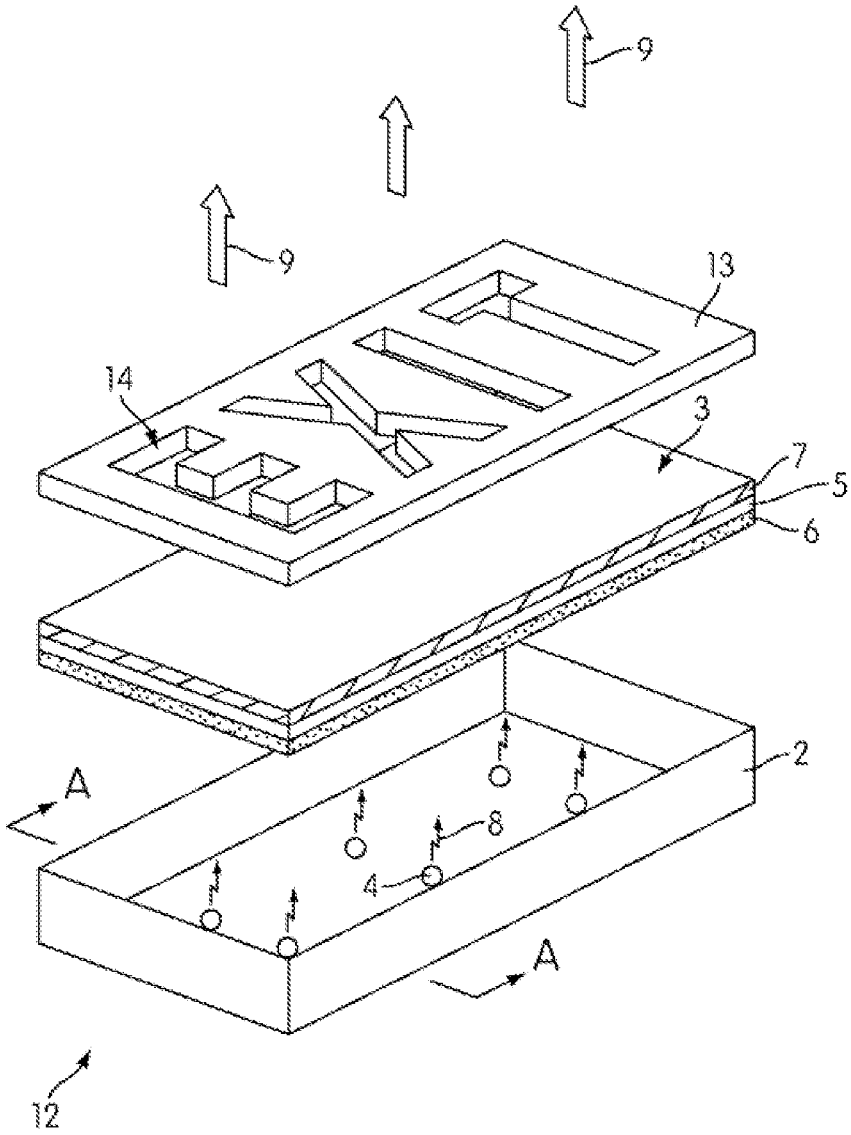
FIG. 2*a* is an exploded perspective view of a backlit light emitting exit sign in accordance with the invention.
Figure 2B:
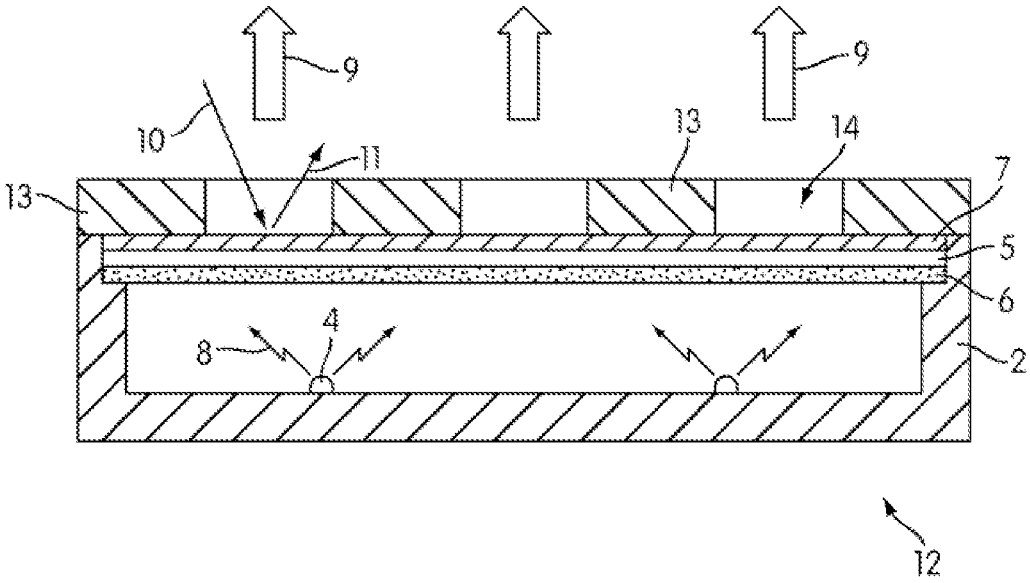
FIG. 2*b* is a cross-sectional view through the line 'AA' of the sign of FIG. 2*a;*

Referring to FIGS. 2*a* and 2*b* there are respectively shown an exploded perspective view of a backlit light emitting "exit" sign 12 in accordance with the invention and a cross-sectional view through the line 'AA' of the sign of FIG. 2*a*. Throughout the description the same reference numerals are used to denote like parts.

In the embodiment illustrated in FIGS. 2*a* and 2*b* the light box 2 and light emitting display surface 3 are rectangular in shape. Like the sign of FIG. 1, the light emitting display surface 3 comprises a transparent/translucent substrate 5, for example polycarbonate material, a BAEC phosphor layer 6 and a reflective color enhancement filter layer 7. The sign 12 functions with the blue LEDs 4. In the embodiment illustrated in FIG. 2*a* the information displayed by the sign, the word "EXIT", is defined by means of a mask or stencil 13. The mask/stencil comprises a sheet material which is opaque and in which apertures/windows 14 have been cut/formed through the entire thickness of the mask to define the word "EXIT". Alternatively the mask 13 can comprise a transparent material on one side of which an opaque mask is provided such the required letter, symbol or device is defined by transparent regions of the mask. In yet a further arrangement, which is not shown, and which is the inverse of the mask shown, the mask comprises light blocking regions to define any required information including for example a character, symbol or device. With such an arrangement the character/s will appear black on a colored light emitting background.

Figure 3:
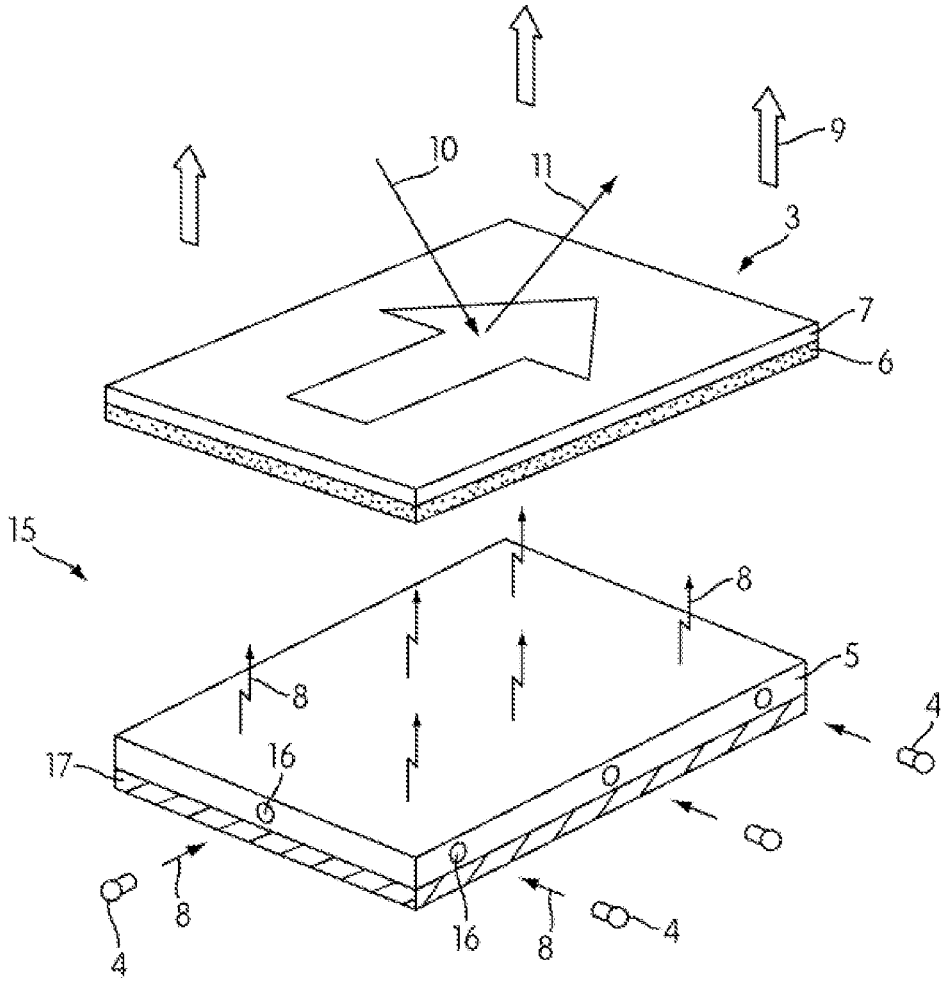
FIG. 3 is an exploded perspective view of a side lit light emitting arrow indicator sign in accordance with the invention.

Referring to FIG. 3 there is shown an exploded perspective view of a side lit light emitting arrow indicator sign 15 in accordance with another embodiment of the invention. In this embodiment the light box 2 is dispensed with and the excitation light 8 from the LEDs 4 is coupled directly into one or more edges of the substrate 5 which is substantially planar in form and which comprises a transparent material, such as polycarbonate. Small recesses/indentations 16 can be provided in the edge of the substrate 5 to assist in coupling light 8 into the substrate. It will be appreciated that the substrate will act as a wave/light guiding medium with the excitation radiation spreading throughout the bulk of the waveguiding medium such that it exits a surface of the substrate in a substantially uniform manner. To prevent emission from the underside of sign 15 and to increase the intensity of the output light 9, a reflective surface 17 is provided on the underside of the substrate 5, that is the side opposite to the light emitting surface. Further reflective coatings, not shown, can be provided around the edges of the substrate to reduce light leakage from the edges.

In this embodiment the BAEC phosphor 6 and reflective color enhancement filter 7 are incorporated in a vinyl film. The vinyl film which can be fabricated as a stock item is then cut to shape to define a desired character, symbol or device (an arrow symbol in the example of FIG. 3) and applied to the substrate 5. A particular advantage of a sign in accordance with the embodiment of FIG. 3 is the reduction in overall thickness of the sign which is little more that the thickness of the polycarbonate substrate 5 and can comprise a thickness of five millimeters for example. Where it is required to have a sign 15 which can be viewed from both sides the reflective surface 17 is dispensed with and a further phosphor/reflective color enhancement layer provided on the underside of the substrate.

Figure 4A:
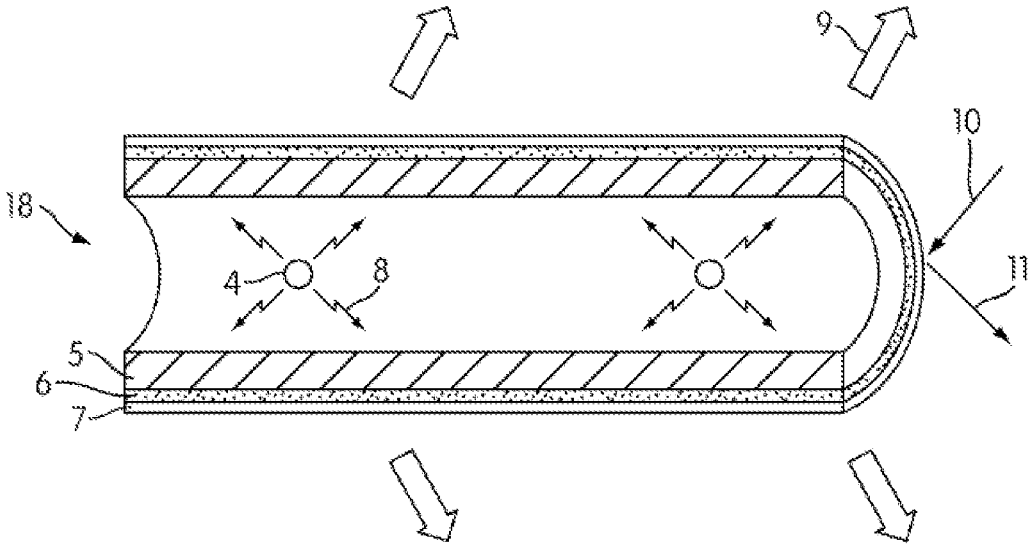
FIGS. 4*a* and 4*b* are schematic cross-sectional representations of light emitting sign in accordance with the invention.
Figure 4B:
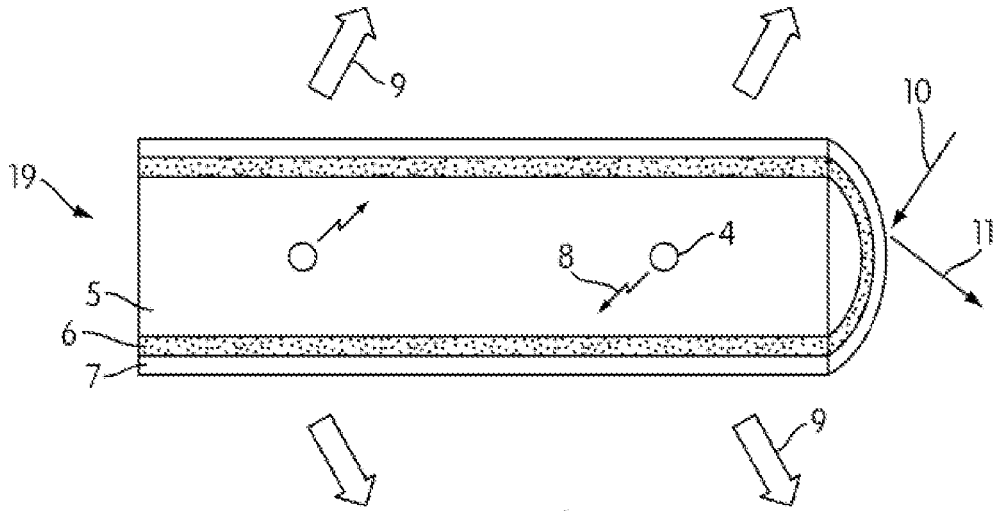

Referring to FIGS. 4*a* and 4*b* there are shown schematic cross-sectional representations of light emitting signs 18, 19 in accordance with the invention which are elongate in form. In the embodiment of FIG. 4*a* the transparent substrate 5 is tubular in form, that is elongate in form with a bore and is fabricated from a thermoplastic material. The phosphor 6 and/or reflective color enhancement layer 7 are provided around the outer curved surface of the tube. The LEDs 4 are provided within the bore of the substrate after fabrication of the substrate. The operation of the sign 18 is substantially the same as described for the previous embodiments. Since the substrate is made of a thermoplastics material, the sign 18 can form a display of any desired characters, symbols or device by heating the substrate and bending the tube into the required form around for example a suitable jig. Referring to FIG. 4*b* there is shown a sign 19 in which the substrate 5 is solid and elongate in form. In this arrangement the LEDs are incorporated in the substrate material. As with the embodiment of FIG. 4*a* the sign is formed by configuring the substrate 5 to display a desired character etc.

Figure 5A:
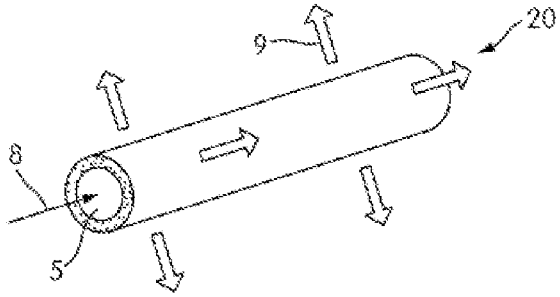
FIGS. 5*a* to 5*d* are schematic representations of further various embodiments of light guiding light emitting signs.
Figure 5B:
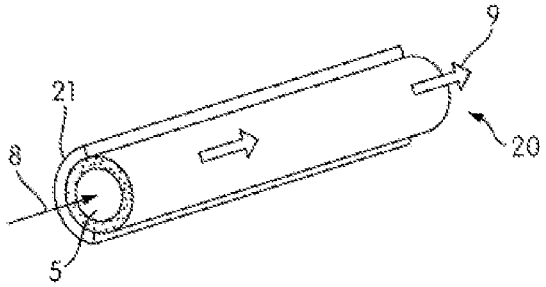

FIGS. 5*a* to 5*d* illustrates further light emitting signs 20, 22 in accordance with the invention which are elongate in form and which act as a light guiding medium. As with the signs of FIGS. 4*a* and 4*b* the substrate 5 is configured into a form to display a desired character etc. In FIG. 5*a* the sign 20 comprises a transparent substrate 5 which is rod like in form and in which the light 8 is injected into one or both ends of the rod 5. The excitation energy is wave guided along the length of the rod by internal reflection. FIG. 5*b* shows the sign 20 and further comprises a reflecting surface 21 on at least a part of an outer surface of the substrate/display surface. The reflector 21 increases the intensity of the emitted light in a preferred direction.

Figure 5C:
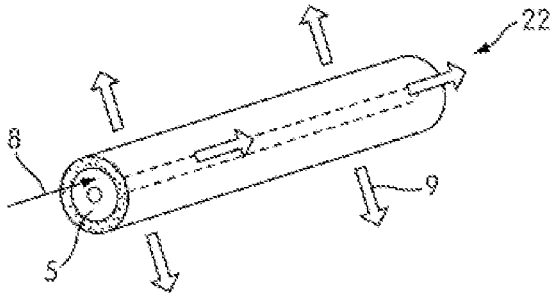
Figure 5D:
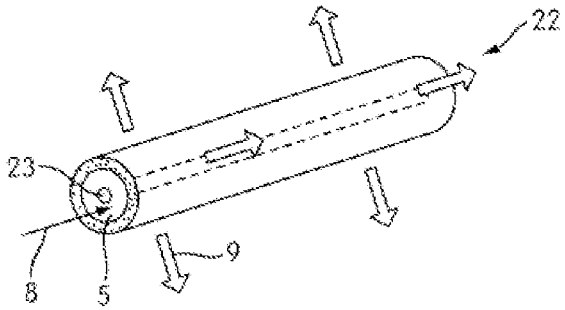

In FIG. 5*c* the sign 22 comprises a transparent substrate 5 which is in tubular in form, includes a bore and in which the light 8 is injected into one or both ends of the wall of the tube. The excitation energy is wave guided along the length of the tube by internal reflection. FIG. 5*d* shows the sign 22 and further comprises a reflecting surface 23 on at least a part of the surface of the bore. The reflective surface increases the intensity of the emitted light 8 from the sign. Moreover, the sign 22 can further comprise a reflecting surface 21 (not shown) on at least a part of an outer surface of the substrate/display surface to increase the intensity of the emitted light in a preferred direction.

The signs 18, 19, 20 and 22 also find particular application as a light source for a light emitting sign. For example these signs can be used as the light source within a light box, for example the arrangement of FIG. 1, in which the display surface 3 is replaced with a translucent layer to ensure a uniform light output over the entire surface. A particular benefit is the reduction in the quantity of phosphor required to fabricate the sign though there will be a corresponding reduction in color saturation/intensity of emitted light.

Figure 6:
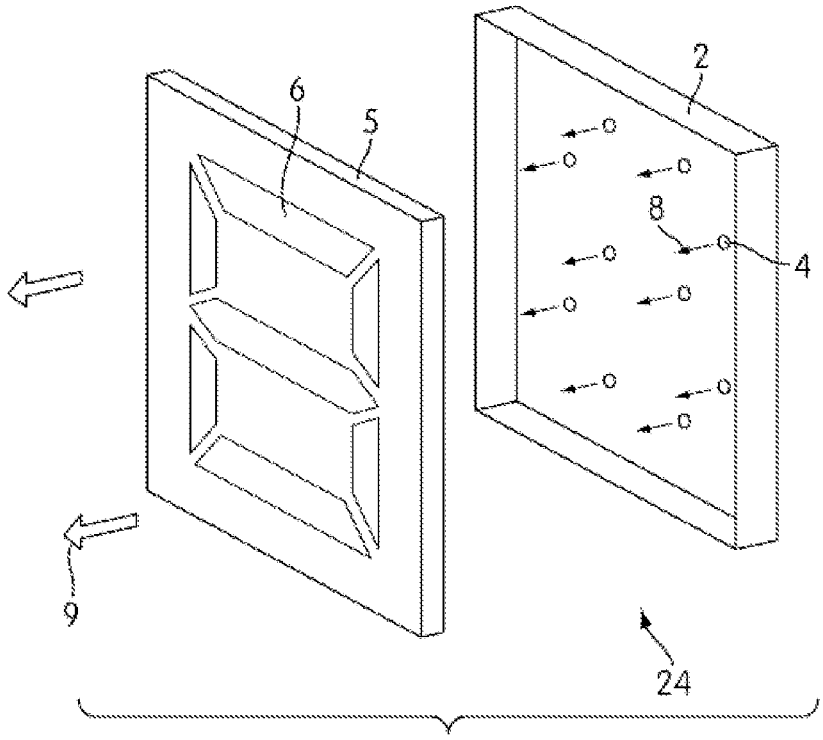
FIG. 6 is a schematic representation of a switchable light emitting sign for producing a selected numeral.
Figure 7:
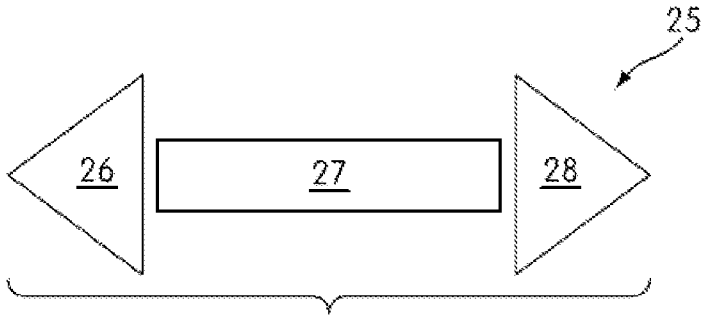
FIG. 7 is a representation of a switchable arrow indicating sign.

Referring to FIG. 6 there is shown a schematic representation of a switchable light emitting sign 24 for producing a selected numeral. The sign 24 is backlit and has a light box 2 containing an array of blue LEDs which are selectably switchable. The phosphor 6 and/or reflective color enhancing filter 7 are configured as segments of a multiple segment display (in this example a seven segment display for display Arabic numerals) which overlay one or more respective LEDs. A desired numeral can be generated by the sign 24 by activation of the appropriate LEDs/segments. FIG. 7 illustrates a switchable arrow indicating sign 25 which comprises individually activatable symbols 26, 27 and 28 in an analogous manner to the sign 24. The sign 25 can selectably display right (regions 27, 28 activated) and left (regions 26, 27 activated) pointing arrows by activation of the associated excitation source/s.

Creating a Full Color Palette Using Blue Activated Emissive Colorants (BAECs)

As described it is possible to create a full range of colors using the BAEC approach. There are blue activated phosphors that will emit in the red, orange, yellow and green ranges of colors. A set of phosphors in this color range can be optimized to create a final set of "primary" phosphor colors. To achieve color hues that fall in between these primaries it is necessary to blend the two closest phosphor colors. Increasing the number of primary BAEC phosphors can increase the color gamut. However this also increases cost so an optimized set of primaries is preferred. The least number of primary phosphors that could be used is two: red and a green combined with the blue LED as the third primary gives an RGB set of primaries.

Figure 8:
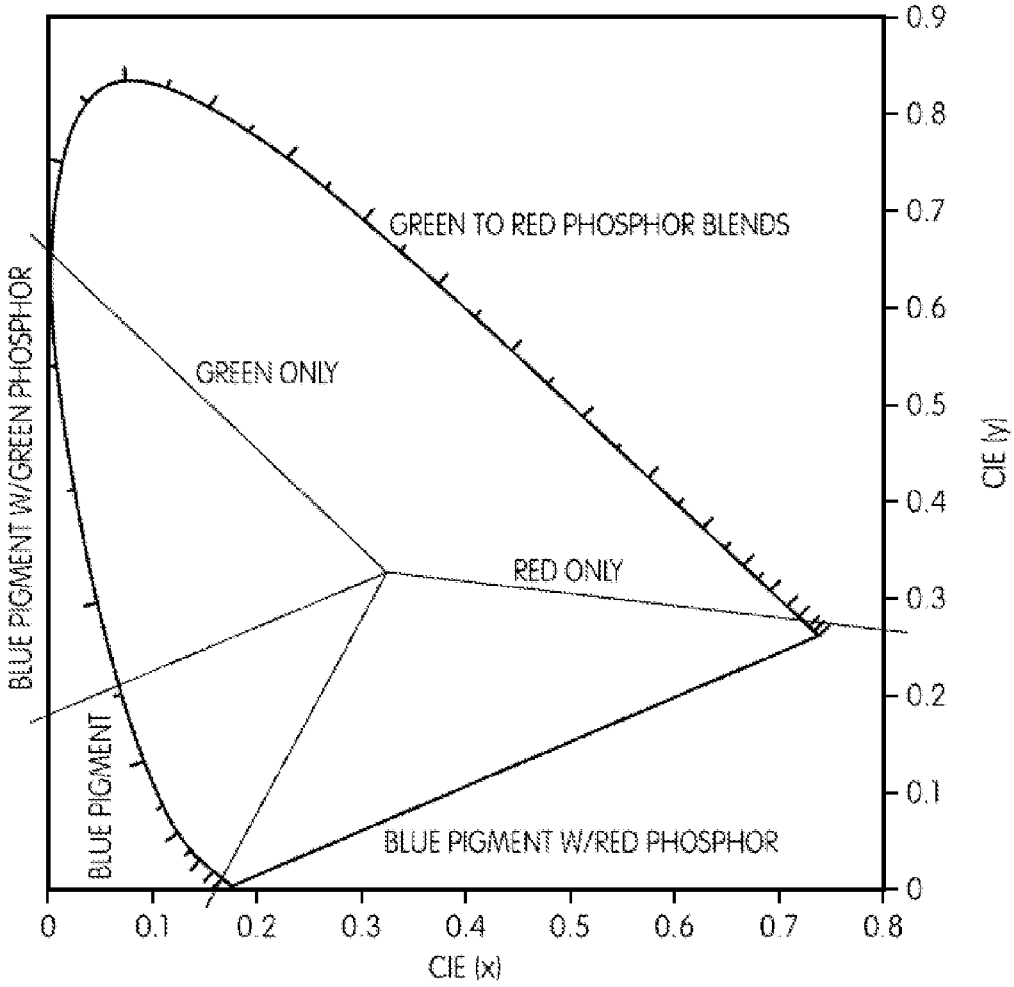
FIG. 8 is a C.I.E. Chromaticity diagram illustrating the effect of pigment enhancement.

The BAEC architecture requires that the specific frequency and light emission intensity of the blue LEDs be specified in order to develop predictable, reproducible colors. In theory, only a blue LED, a red phosphor denoted the letter R and a green phosphor denoted by the letter G are needed for a complete color space, however in practice all phosphor materials and LEDs have limitations on color saturation and efficiency. With the optical parameters of the blue light defined, for example wavelength and intensity, the use of color filter pigments and/or dyes in the blue and blue/green color space can be used to enhance the blue colors, termed Pigment Enhancement as illustrated in the C.I.E. chromaticity diagram of FIG. 8. Pigment enhancement is considered inventive in its own right. As the colors approach green, a blend of pigment enhancement and phosphor can be used to create the most saturated blue/green hues in BAEC materials. The blue pigment enhancement will allow for greater saturation and hue control of the blue colors. Like the phosphors it is preferred that a limited number of blue/blue green pigments are selected as pigment enhancement primaries.

As described, mauves/purples are created by a visual blending of blue and red light. For these colors the blue LED (possibly with pigment enhancement) can be blended with a red phosphor primary. By varying the amounts and density of these two colors the shades of purple will be created.

The following sections describe some of the possible BAEC materials sets and the applications they could serve.

BAEC Vinyl Films

There are estimated to be over 20,000 sign shops in the USA. One of the most common methods of producing signs and displays is the use of cut vinyl films. These films are mass produced both using casting and calendaring. The term "transparent" or "translucent" is used to describe them because the color pigments filter light through them whereas "opaque" colorants block light. For example clear red cellophane uses a "transparent" red pigment and acts as a red filter. On the other hand red house paint is opaque. Transparent colored films are used with white backlights as a common signage system. A set of transparent colors for a competitive product line is in the range of 20-30 different colored films. The customer of the sign picks the colors used for each part of the sign. This is called "spot color" because each region (letter or graphics element) is only a single solid color using a single color material. No blending is used. These thin vinyl films are too soft to be used without support. They have an adhesive back and are then applied to a more robust, translucent substrate. In accordance with the invention a set of BAECs vinyl films can be created for use with blue LED backlit and front lit signs.

BAEC Polycarbonate and Acrylic Films

For more expensive signs and displays, colored polycarbonate or acrylic sheets are used. The shape of the letters is routed out of the solid sheets and then put in custom light boxes shaped like the letters. A set of BAEC polycarbonate and/or acrylic sheets can be made for these applications. In addition to signage, these plastic sheet goods can be easily machined and thermoformed. They are frequently used for fabricating furniture, lighting, display cases, and other custom products. The inventors contemplate using BAEC polycarbonate and acrylic panels in such products where blue LED illumination can be used. The effect will be light emitting plastic products that can be fabricated in any color. BAEC panels will allow any user to fabricate color light emitting products all using the same blue LEDs, by selecting the appropriate BAEC material.

BAEC Spot Color Inks

Spot color inks are commonly used for logo colors or graphics where there are specific colors but generally not used in the reproduction of photographic quality images. They can be brighter than "process color" and also are easier to use in many applications. BAEC Spot Color Inks can be developed for screen printing, inkjet, gravure, offset and flexo-printing and phosphor-based inks can be used in all of these printing processes including inkjet printing. It is anticipated that screen printing inks will be the most useful and effective because of the thicknesses and solids content required to achieve good color with the BAEC phosphors. It may not be possible to have a full, saturated color space with offset, gravure and other low viscosity, thin ink layer printing techniques.

BAEC Process Color Inks—Additive RGB Inks Versus Subtractive CMYK

Process color requires a set of primary color inks For traditional subtractive printing this color space is CMYK (Cyan, Magenta, Yellow and black). As described earlier traditional pigments are subtractive with each color ink acting as a transparent color filter. Because BAEC process inks will create light they will function more like a CRT or LCD display—using additive color theory. In additive color theory the primary colors are RGB (Red, Green, and Blue).

It is well known in color reproduction that additional "primaries" can be added to a color space resulting in improved color quality. For example the Pantone system well known in the art supports a six color process color system called "Hexachrome". It works on the same principle of subtractive color as the standard CMYK inks, but these additional pure color inks replace blends of the four primaries for specific areas of color where the blends have reduced saturation.

In theory a BAEC set of inks can be as simple as Red and Green inks to create a basic RGB color space. The blending of these colors using half-tone printing and other printing patterning would be similar to those techniques well understood and used for traditional process color printing. It is anticipated that more primary colors will be used in most BAEC process ink systems. A combination of pigment enhanced inks in the blue and blue/green would be combined with selected BAEC phosphor inks to create a family of primary color inks that could be used for process color printing.

BAEC Color Mapping

Color mapping is used in the development of the BAEC color systems. The first step in color mapping is to create a density color map for each primary color. As the density of the phosphor (or enhancing pigment) is increased the amount of unchanged blue light transmitted is reduced. This results in a color shift in the emitted light from the blue LED hue toward the primary color hue. As the density increases however the hue shift reduces and efficiency will start to drop as the density of the primary color material becomes too thick and traps light.

Density mapping is used in two ways. First, as the hue shifts different colors are created. By saving the color measurement values for every density value of each primary a table of available colors is determined. The second and equally important use of density color mapping is to find the optimal loading for achieving the pure primary color before there are efficiency losses.

After density mapping, with the optimal density settings blends of neighboring primaries will be made and color sampled to create a contiguous color space. From green to red these will be blends of adjacent colored phosphors. From green/blue to blue it will be blends of the green phosphor to the blue enhancing pigments. From blue to red (purples) blends of red phosphor and blue will be used. Once sampling of all of these blends is completed a color look up table database is created. This table can then be used to find the best color blend formulation to create any color.

Reflective Color Enhancement Using a Reflective Color Layer

One of the challenges of using phosphors in signage applications is that they do not have the same appearance when activated in white light (sunlight) as they do when activated with the blue LED in emissive mode. This is because the phosphors will reflect much of the white light in addition to emitting the target color. In reflective mode, many phosphors appear "washed out" with decreased color saturation and there is often a color shift compared to emissive mode. Blue-excited phosphors also selectively absorb blue light from white light thus looking colored in ordinary white room-light or daylight.

Figure 9A:
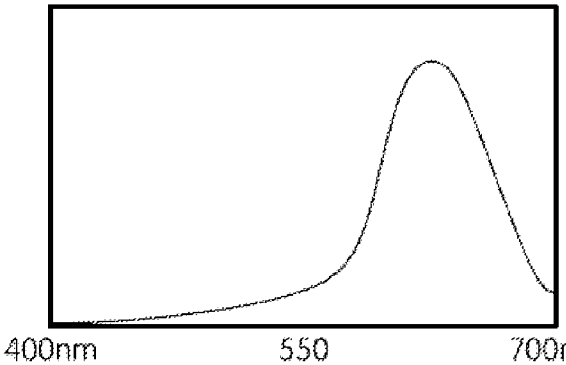
FIGS. 9*a* to 9*d* are plots of intensity versus wavelength for (a) a blue activated red phosphor in an emissive mode, (b) a blue activated red phosphor in a reflective mode reflecting daylight (white light), (c) an absorption curve for a color enhancement layer, and (d) a blue activated red phosphor in reflective mode including reflective color correction.
Figure 9B:
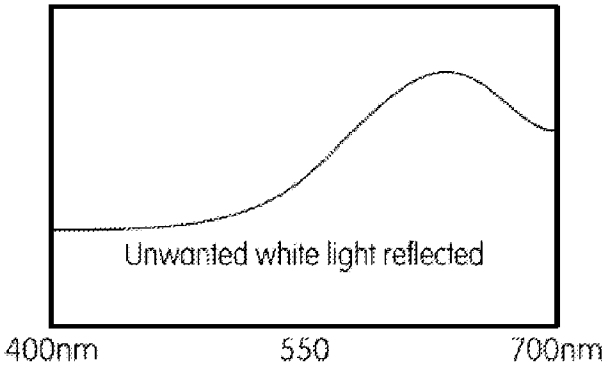

For applications such as outdoor signage it is important that the reflective color and emissive colors of the sign are as substantially similar in color and hue as possible. This is a problem today for backlit signs which use transmissive filters. The color quality in daylight (reflective mode) is different than in night-time (transparent mode or backlit mode) as illustrated in FIGS. 9*a* and 9*b*. In accordance with the invention this problem can be mitigated by using a thin layer of transparent pigment on the front surface of the display surface. This is called "reflective color enhancement". With reflective color enhancement the spectral response of the reflected light coming from the phosphors is compared with the emissive light reflected from the same phosphor surface. In the reflected state the desired frequencies of light are emitted, but additional wavelengths of light are reflected creating the color shift and "washed out" appearance in the final reflected color.

Figure 9C:
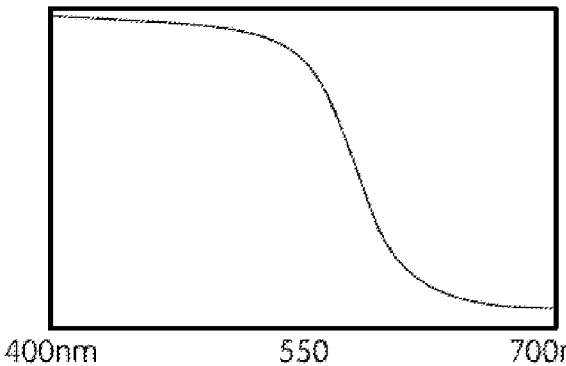
Figure 9D:
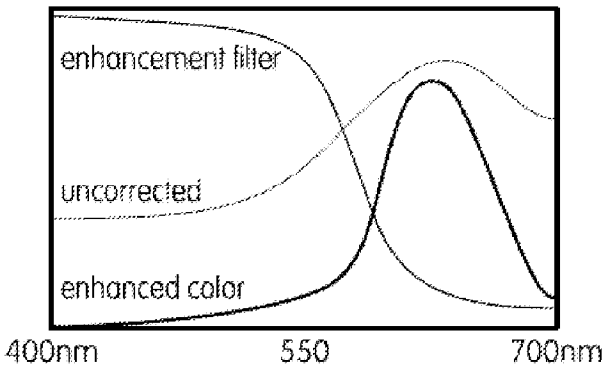

By adding a transparent color enhancement filter layer 7, comprising for example a color pigment, in front of the phosphor layer 6 it is possible to absorb the unwanted frequencies of light leaving only the target color. FIG. 9*c* shows the absorption curve for a color enhancement layer. By using this technique of reflective color enhancement it is possible to create a BAEC phosphor layer that appears the same color in emissive mode as well as reflected mode (daylight), see FIG. 9*d*. The use of a color enhance filter is considered inventive in its own right.

To avoid loss of efficiency care must be taken to place the color enhancement filter layer in front of the colored phosphors. This is because the color enhancement filter layer will frequently absorb the blue LED light that activates the phosphors. If the color enhancement filter layer 7 is between the colored phosphors and the blue LED light source than there will be a loss of efficiency due to the absorption of blue light. For this reason the color enhancement pigments are not blended into the phosphors, but are provided as a separate layer in front of the phosphors. It will be appreciated that use of an enhancement layer also requires that the display be backlit so the blue LEDs is unobstructed when lighting the phosphors. After being converted into the target colored light by the BAEC layer, then the color enhancement layer will not significantly impact the color. In fact it may increase saturation in emissive mode as well.

Creating Reflective White Light

In many signs there is a need for reflected white. White emitting LED are known and comprise a blue LED which incorporates a yellow phosphor in a thickness that still permits some of the blue light to pass through the phosphor. The sum of yellow light from the activated phosphors and the blue light of the LED that passes through creates the final balanced white.

BAEC materials create white in a similar way, but the yellow phosphor will be remote in the display surface. However, in reflective mode these BAEC white panels will appear yellowish. To correct this hue problem a thin color enhancement layer containing a blue pigment is used. This will have some minor efficiency impact on the final panel performance in emissive mode. A user will have to decide if having a balanced white in reflective mode is worth the additional filtration and minor light loss in emissive mode. In addition a light diffusing layer can be used to create a balanced reflected white light. The yellow phosphors (for example YAG:Ce) already reflect a white/yellow light. If a light diffusion panel is provided in front of the phosphor layer (which is often done in panel design) additional white light may be reflected by the diffusion panel lessening the need for blue correction.

Emissive Color to Improve Night-Time Performance and Color Quality

Traditional white backlit signs with transparent colored materials on top (like transparent vinyl and acrylic sheets) offer reliable low cost color however, increasing brightness leads to the bleeding through of the white backlight. This addition of white light leads to a shift in the color saturation, i.e. for red, deep red to a washed out whitish (pink) red. According to one aspect of the invention the use of phosphor based signage consumables (rolled or sheet goods) offers increased brightness without deterioration in color saturation and quality. With the invention, as the blue-backlight power is increased, as long as the amount of phosphor in the front material is high enough, a brighter and brighter single color be seen by the viewer.

Emissive Color Improvement Using an Enhanced Color Layer

It has been assumed so far that the blend of BAEC phosphors can be used to create a desired color saturation for the full color space. However, many phosphors have broader light emission spectrums than desired for highly saturated color. Also using the phosphors to completely eliminate all blue light leakage from the LEDs may require a very thick layer of phosphor which may be inefficient or undesirable.

Figure 10:
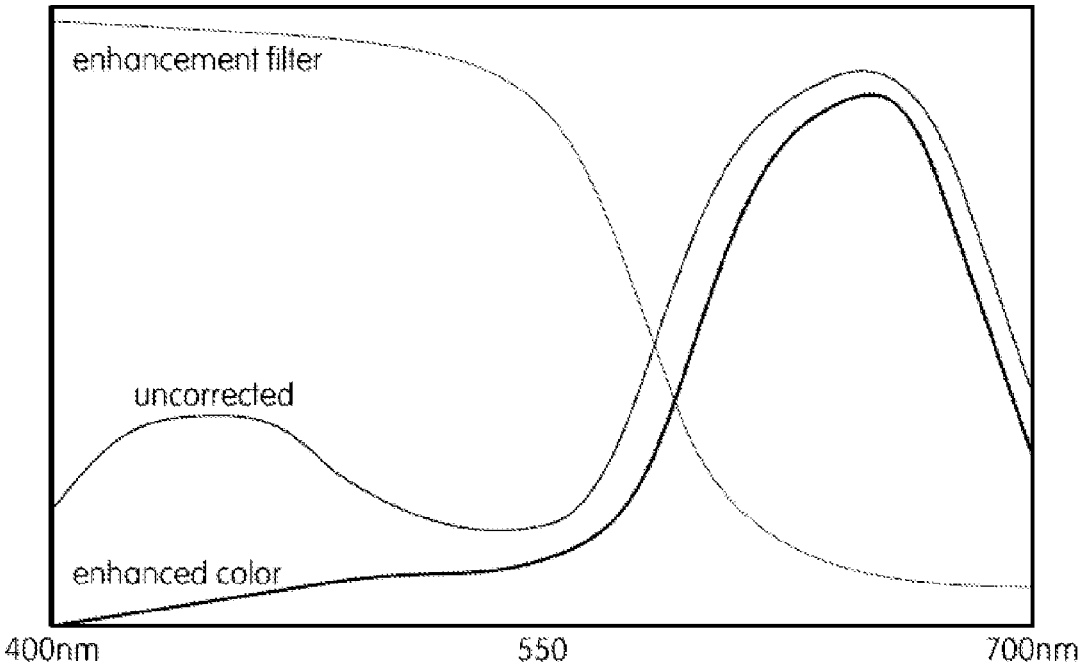
FIG. 10 are plots of intensity versus wavelength for a blue activated red phosphor in uncorrected and enhanced color emissive modes and a color enhancement filter characteristic.

In an analogous manner to the way in which the color enhancement layer is used to achieve improved reflective color, the same principle may also be used to enhance the emissive color, see FIG. 10. Although a phosphor may create sufficient light in the target color frequency, there may be a broader emission curve than desired for high color saturation and/or blue light may still pass through the phosphor. Both of these can be corrected by a color filter layer in front of the emissive phosphor layer.

Producing Photographic Images and Grey Scales Using BAEC Color Inks, White and a Black Layer BAEC primaries can be used to create a fully saturated gamut of all pure colors (a two dimensional color space). Because all colors share the same uniform backlight the intensity of the colors will all be similar, a function of their conversion of the blue LED light into the new target color. This type of saturated color is desirable for most signage, spot color graphics, lighting and architectural applications. However, it is not possible to decrease individual color's brightness because reducing the amount of phosphor for any individual color will cause more blue light to pass through and result in a blue color shift.

However, in photography and continuous tone graphics there is a need to blend white and black into pure colors to control brightness and saturation. By blending white and black into the saturated colors it is possible to control saturation and brightness even with a fixed blue LED light source shared by all colors. This additional blending of white and black will enable the printing of photographic images (a full 3 dimensional color space).

Adding white to a color can be accomplished by:

1) Replacing some of the colored BAEC phosphors in a specific area with a specific amount of yellow phosphor and 2) Reducing the phosphor density sufficiently in that area such that some blue light from the LED can bleed through (yellow plus blue create white).

The amount that 1) and 2) are applied needs to be color mapped as explained in the earlier section on color mapping.

To control lightness and darkness an opaque black layer is added. The black layer creates a light filter that will control the amount of light passing through. This will permit grayscale printing and controlling of color brightness. Black ink is opaque (usually based on carbon pigments) and the result is a uniform absorption of all light in that area. If a color enhancement layer is used, the black layer can be printed in conjunction with the color enhancement layer to reduce cost and complexity.

Through color sampling and mapping of the various blends of color and white and black it will be possible to create a complete 3 dimensional color map of the BAEC color system. With a full color map of the color primaries with white and black creating grey scale it is possible to achieve a full photographic color space and print photography using BAEC inks. The result will be a light emitting photographic image that responds to blue LED illumination.

The above color separation shows how significant the black layer is in creating a printed color image. In addition it is possible to see how much white is also used in each of the color layers. Adding white and black are necessary to create a photographic color space for printable BAEC phosphors. With BAEC colors the primaries are changed from subtractive CMY (Crimson, Magenta, and Yellow) to additive RGB, but the same principles of white and black apply in either color system.

Planar Dot Patterns to Improve Phosphor Efficiency

Figure 11A:
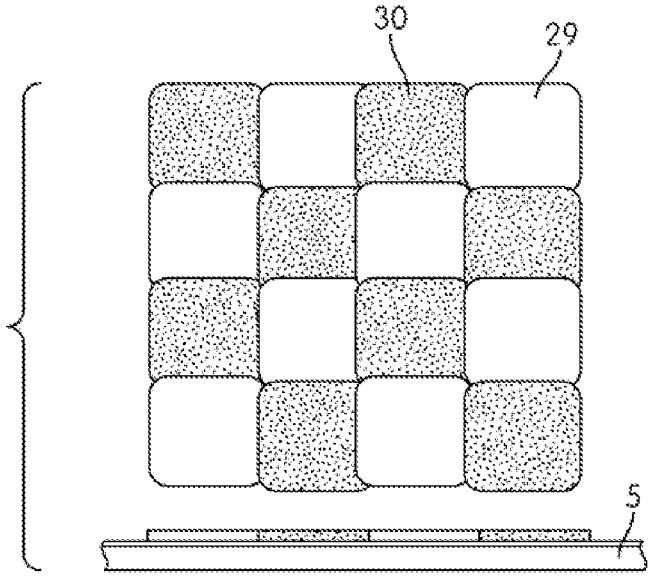
FIGS. 11*a* and 11*b* are schematic representations of (a) a pattern of phosphor dots in accordance with the invention and (b) a layout of ink dots used to generate a photographic image in a conventional printing scheme.
Figure 11B:
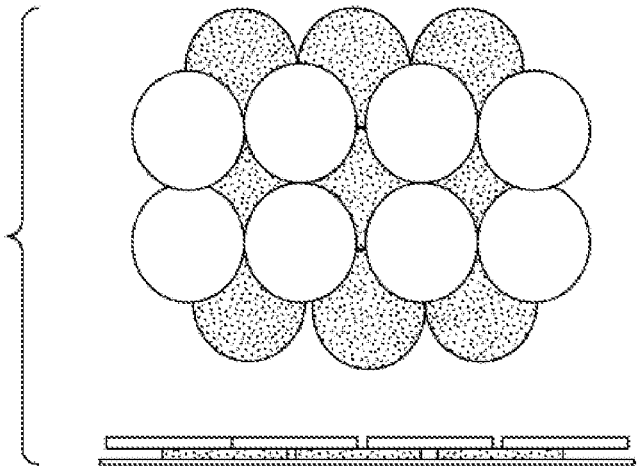

Unlike transparent CMY inks, the BAEC phosphors and colorants will be impacted if they are layered directly on top of each other as in conventional photographic printing, see FIG. 11*b*. This is because the phosphor closest to the blue LED light source will absorb the blue light and convert it into the emissive color. If the next phosphor is layered on top of the previous phosphor it will not be activated by as much blue light and it will absorb some of the color light created by the first layer of phosphor. If blue enhancing colorants are used and phosphors are put on top of them, the corrected blue light will be absorbed and changed by the phosphors on the surface making the correction less effective. Overlapping the color layers in BAEC materials results in reduced efficiency and more difficult color blending.

A solution to this problem is to create dot patterns where the phosphors 29, 30 are adjacent to each other on substantially the same plane, FIG. 11*a*. In a planar printed pattern the material act independently and with maximum efficiency. The color blending of the juxtaposed colors is done in the eye similar to the RGB pixels of a TV screen. A key to this system is to be sure the color dots 29, 30 are small enough to have adequate color blending in the eye. Registration of the printing process is also important.

Differential wetting of the inks is used to create a natural separation of the inks on the substrate. For example in the above case if the yellow ink is water based and the red ink is oil based then they will be phobic to each other and tend to wet the substrate and avoid overlapping each other. The surface energies of the inks should be matched to each other so they are hydrophobic to each other but both are still reasonably hydrophilic to the substrate.

It will be appreciated that the various signs herein described share the following features:

A single excitation source, preferably a single color of blue LED, is used as the light source (410-480 nm range). Use of a single type of blue LED replaces the need for white backlighting or diverse colored light sources.

Unlike phosphor modified color LEDs, these blue LEDs do not require modification with phosphors. All color light other than blue is created by a "remotely" located BAEC (blue activated emissive colorant) material, phosphor. The BAEC material is not used to modify the physical light source in that they are not printed or cast into the LEDs, they are not put inside the tubes of a UV fluorescent light tube or in any other way used to directly modify a light source. Instead they are printed, cast or otherwise patterned onto a remote display surface. In the case of a backlight panel the color graphic containing the emissive BAECs is on a front display panel or directly cast in the plastic or other polymer film of the front panel. BAEC containing devices can be either backlit or front lit by the blue LEDs.

BAECs are offered in color material sets. Preferably, a set of BAEC materials is provided in a full gamut of colors for each type of target application. The BAEC material sets are designed to offer a complete set of colors so the user can design various color products using one set of BAEC products. To create color sets different phosphors and pigments are blended and color mapped to create a full palette of products with similar blue response and good color saturation. Product sets that contain BAEC powders may be offered in different form factors including but not limited to flexible vinyl films, rigid polycarbonate sheets and screen print inks. The pre-fabricated BAEC materials sets allow the user to customize the design of light emitting color products and graphics displays simply by selecting the target color BAEC material (as in the case of cut vinyl signs) or by printing with the BAEC inks (as in screen printed signs or displays). This system allows user to create a broad variety of colored light emitting devices and displays using only one type of standard light source (blue LED) and the BAEC materials.

BAECs will combine color pigments with color phosphors to achieve blue/green light emitting materials. Phosphors will be used to create all colors from red to yellow through green. As the target color approaches blue there is no need for a phosphor to generate the blue light since the LED is already creating light in those frequencies. In the areas of the color space where the LEDs are producing blue light, color filter pigments may be employed (called pigment enhancement). Because blue LEDs are efficient the use of the color pigments in BAECs is primarily to "tune" the hue of the blue color. Colors in the blue/green spectrum will also need green light so blends of blue pigments with green phosphors may be used to create colors in the blue/green space.

The same BAECs phosphor approach can be applied to work with UV light sources. Using UV light, blue emitting phosphors are needed for blue color reproduction. However, the use of blue LEDs in place of UV in many applications is more desirable because UV has the drawback of being more destructive to organic materials. Also exposure to UV light can damage eyesight so UV systems usually need to be light tight to protect an observer. Blue LEDs are also plentiful, low cost and very reliable. Short wavelength blue LEDs in the range of 410-470 nm are preferred because they will be more efficient in exciting the phosphors and they will offer a more pure blue light that would need less color pigment enhancement. Moreover, since blue LEDs don't damage the eye the BAEC light emitting materials do not need to be enclosed or in intimate contact with the blue LEDs. A device using the BAEC architecture can be open and consequently an blue LED spotlight can be used to illuminate a BAEC display either in front or behind and will emit the target image from both sides (assuming a dark ambient environment).

It will be readily apparent to those skilled in the art that modifications can be made to the sign/display arrangements disclosed without departing from the scope of the invention. For example whilst exemplary implementations have been directed to fixed sign displays the inventor's envisage that the inventions can also be applied to other applications where it is required to generate light of a selected color over large area such as for example accent lighting and architectural lighting applications.

What is claimed is:

1. A light emitting sign comprising:

a plurality of blue LEDs operable to generate blue excitation light and a light emitting display surface comprising a light transmissive substrate and at least one phosphor overlaying at least a portion of one face of the substrate, wherein the phosphor is configured to absorb at least a portion of the blue light generated by the LEDs and, in response, to emit light of a selected color; and a reflective color enhancement layer overlaying the phosphor, wherein the reflective color enhancement layer is configured to reflect wavelengths of light from sunlight corresponding to light produced by emissions of the blue LEDs and the phosphor, and to substantially absorb other wavelengths of the light from the sunlight.

2. The sign of claim 1, wherein the regions of the display surface intended to generate blue light further comprise a color filter configured to generate a selected hue of blue light.

3. The sign of claim 1, wherein the phosphor is selected from the group consisting of being:

provided as a layer on at least a part of the surface of the substrate facing the LEDs;

provided as a layer on at least a part of the surface of the substrate opposite the LEDs; and incorporated within the substrate and combinations thereof.

4. The sign of claim 1, wherein the phosphor is deposited onto the surface of the substrate using a technique selected from the group consisting of: screen printing, inkjet printing, gravure printing, and flexo-printing.

5. The sign of claim 1, wherein the phosphor is incorporated in a vinyl film applied to the substrate.

6. The sign of claim 1, and further comprising a second phosphor wherein the first and second phosphors are selected from the group consisting of being:

provided as respective layers;

provided as a mixture in at least one layer;

incorporated as a mixture in the substrate;

provided as a pattern of non-overlapping areas of the first and second phosphors;

provided as a pattern of overlapping areas of the first and second phosphors; and combinations thereof.

7. The sign of claim 6, wherein the first and second phosphors are selected from the group consisting of being provided as: a pattern of non-overlapping substantially square areas of the first and second phosphors; and a pattern of overlapping substantially circular areas of the first and second phosphors.

8. The sign of claim 1, wherein the substrate is selected from a group consisting: a plastics material, polycarbonate, a thermoplastics material, a glass, acrylic, polythene, and a silicone material.

9. The sign of claim 1, wherein the reflective enhancement layer comprises an organic colored pigment and/or a colored dye incorporated with a binder material.

10. The sign of claim 1, wherein the substrate is configured to define a symbol or character of the sign.

11. The sign of claim 1, wherein the substrate is configured as a light transmissive window such that substantially all light generated by the sign is emitted from the substrate.

12. The sign of claim 11, and further comprising a light box housing the LEDs and wherein the light emitting display surface overlays the light box opening.

13. The sign of claim 1, wherein the reflective color enhancement layer overlays the phosphor on the side opposite from the substrate.

* * * * *